United States Patent [19]

Claflin

[11] Patent Number: 4,495,054

[45] Date of Patent: Jan. 22, 1985

[54] METHOD OF OPERATING A BLAST FURNACE TO EXTRACT CARBONACEOUS OIL AND GAS FROM BITUMINOUS MATERIALS

[76] Inventor: H. Bruce Claflin, 2436 Park Blvd., Upland, Calif. 91786

[21] Appl. No.: 176,910

[22] Filed: Aug. 11, 1980

[51] Int. Cl.[3] ..... C10G 1/02; C10B 53/06; C10B 47/04

[52] U.S. Cl. ..... 208/8 R; 208/11 R; 423/371; 423/380; 201/21; 75/29

[58] Field of Search ..... 208/11 R, 8 R, ; 75/29; 423/371, 380; 201/21

[56] References Cited

U.S. PATENT DOCUMENTS

| | | | |
|---|---|---|---|
| 1,509,667 | 9/1924 | Catlin | 208/11 R |
| 2,589,109 | 3/1952 | Martin et al. | 208/11 R |
| 2,877,086 | 3/1959 | Mackay | 75/29 |
| 3,162,583 | 12/1964 | Hemminger et al. | 208/11 R |
| 4,243,489 | 1/1981 | Green | 208/8 R |

FOREIGN PATENT DOCUMENTS

| | | | |
|---|---|---|---|
| 1364519 | 8/1974 | United Kingdom | 201/25 |

OTHER PUBLICATIONS

Stephenson, R. L.; "Formation of Cyanides and Alkalis in the Blast Furnace"; AISI Tech. Com. on Blast Furnace Practice, Pittsburgh, Dec. 1969.

*Primary Examiner*—Delbert E. Gantz
*Assistant Examiner*—Olik Chaudhuri
*Attorney, Agent, or Firm*—Banner, Birch, McKie & Beckett

[57] ABSTRACT

A blast furnace is employed to process a natural material selected from the group consisting of oil shale, oil sandstone, asphalt rock or mixtures thereof. A first carbonaceous material selected from the group consisting of oil shale, oil sandstone, asphalt rock or mixtures thereof and a second carbonaceous material are charged to the top of a blast furnace and the carbonaceous char material remaining when the burden reaches the lower portion of the blast furnace in front of the primary tuyeres is burned to provide a hot, upwardly-moving gas stream containing CO and $H_2$ to vaporize recoverable hydrocarbons contained in the carbonaceous material as the carbonaceous material moves downwardly through the blast furnace. A gas containing hydrocarbons, CO, $H_2$ and vaporized carbonaceous oil and tar is withdrawn from near the top of the blast furnace and a molten slag is withdrawn from near the bottom of the blast furnace. The off gas can be condensed to provide liquid oils and a gas having a desirable Btu content. Provision is also disclosed for the removal of alkali metals from the process.

21 Claims, 1 Drawing Figure

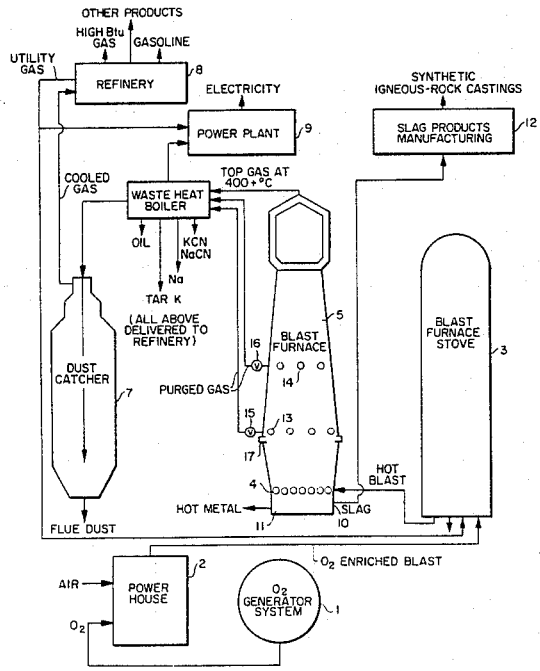

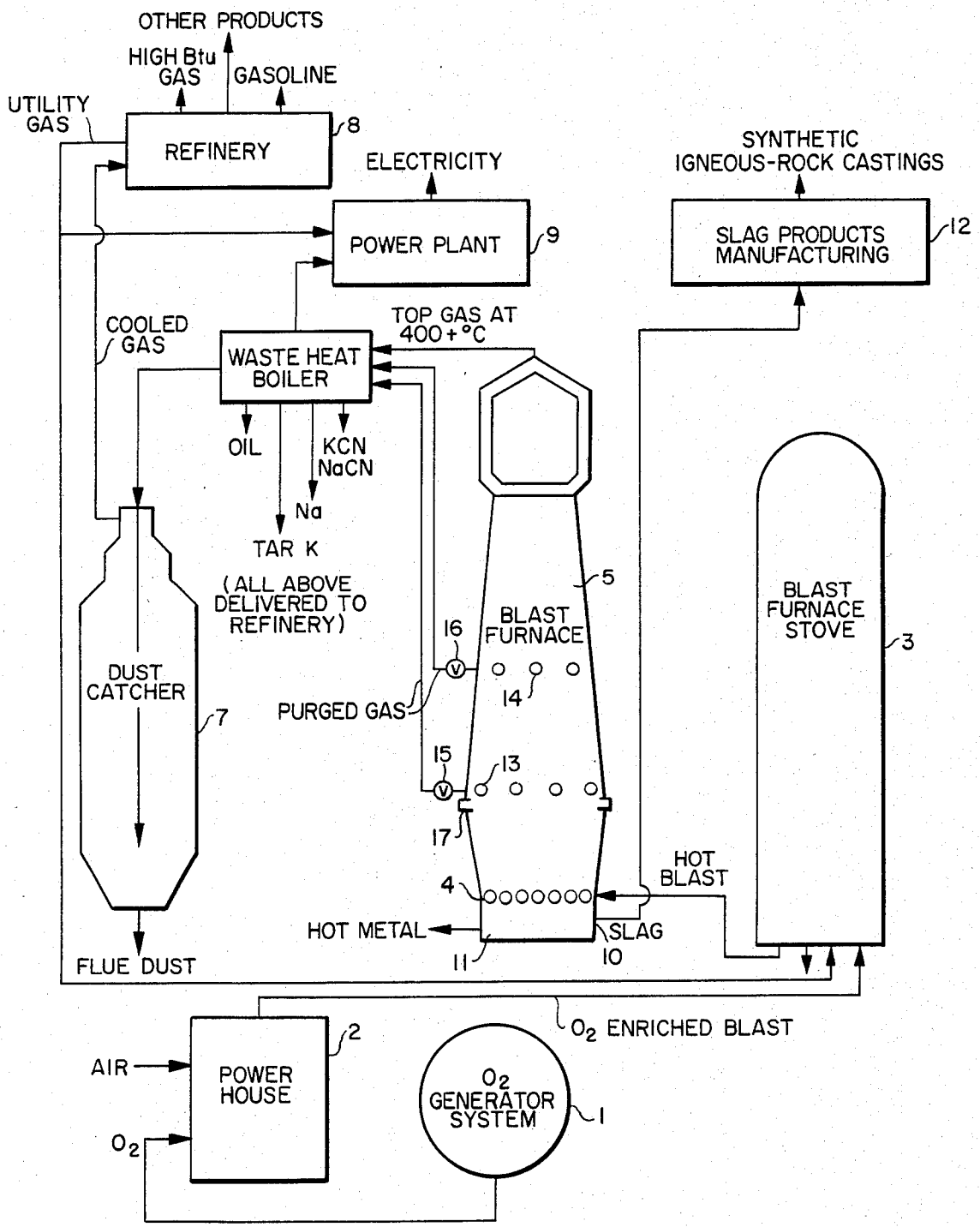
OTHER PRODUCTS
HIGH Btu GAS
GASOLINE
UTILITY GAS
REFINERY
8
ELECTRICITY
POWER PLANT
9
SYNTHETIC IGNEOUS-ROCK CASTINGS
SLAG PRODUCTS MANUFACTURING
12
COOLED GAS
WASTE HEAT BOILER
TOP GAS AT 400+°C
OIL
KCN NaCN
Na
TAR K
(ALL ABOVE DELIVERED TO REFINERY)
DUST CATCHER
7
FLUE DUST
5
BLAST FURNACE
16
14
PURGED GAS
15
13
17
4
HOT METAL
11
SLAG
10
HOT BLAST
BLAST FURNACE STOVE
3
O2 ENRICHED BLAST
AIR
O2
POWER HOUSE
2
O2 GENERATOR SYSTEM
1

METHOD OF OPERATING A BLAST FURNACE TO EXTRACT CARBONACEOUS OIL AND GAS FROM BITUMINOUS MATERIALS

This invention relates to a method of using a blast furnace to extract carbonaceous oil and gas from oil shale or similar materials such as oil sandstone and asphalt rock while simultaneously cogenerating gas and other valuable products from coal or lignites.

Oil shale contains a solidified carbonaceous material called kerogen. When this solid material is released from oil shale by volatilization, carbonaceous gas, part of which may be cooled to form carbonaceous oil, is produced. The carbonaceous oil, which is similar to crude petroleum oil, may be conventionally processed to yield a full range of valuable hydrocarbon products such as kerosene, gasoline and raw materials for the manufacture of plastics. Oil sandstone and asphalt rock contain oil values which may be similarly extracted and refined.

World demand for ever-greater amounts of energy makes efficient and economical kerogen-derived oil extraction highly desirable. It has been estimated that in the U.S. there is over one trillion barrels of oil recoverable from oil shale, which is three times the world's total crude oil reserves (*Zimmerman's World Resources and Industries,* 3rd Ed., Peach and Constantin, Harper & Row, 1972). Additionally, researchers have reported that the oil recovered from kerogen is a better raw material for refining than most crude oils presently being processed. A very large supply of low grade coals and lignite carbonaceous materials is also available.

About 1850 in Scotland, James Young discovered that oil could be distilled from oil shale. This led to the development of a Scottish oil shale industry which did well until the 1920's, and continued to exist until 1962. It succumbed to the economic disadvantage that the operation involved the cost of mining the raw material and retorting it to obtain a liquid material similar to the oil removed from wells already in a condition suitable for processing through the final conventional refining steps.

In more recent attempts to develop an economic carbonaceous oil from the kerogen in oil shale, extraction processes have taken divergent approaches. To reduce the net cost by improving the carbonaceous oil yield per ton of raw material processed, some methods crush the mine run rock into small pieces prior to retorting. Even when this raw material preparation cost is incurred, a substantial carbonaceous content remains with the solid residue and is entirely lost. Various kinds of retorts have been tried. Heat derived in various ways, according to the process, is used to drive off the kerogen components largely in a vaporous form. The kerogen vapors must then be condensed by cooling. The cooling operation frequently uses large amounts of water, a major portion of which is lost. To complete a production cycle, the residue is removed before recharging the next batch of oil shale.

During the retorting process, the shale expands in volume about one and one half times and loses its rock-life characteristics forming a material with small particles. The disposal of this material represents a significant manufacturing cost because of its negative value and undesirable characteristics. Finding an ecologically acceptable means is difficult as it does not compact, and exposed piles are not ecologically acceptable. It has a high alkaline content which leaches readily, making it a ground water purity hazard.

The various retorting operations release emissions, especially during the removal of residuals portions of the cycle, which will require control devices which are costly to acquire and operate. High material handling and material preparation costs and in some processes the need for a large water supply are added retort process handicaps.

The other basic approach involves in-situ techniques. Notwithstanding costly underground preparations, the level of control that can be exercised is not comparable to above ground methods, the net yield of usable products attainable is much lower and there are inherent operating dangers requiring extreme precautions to protect the safety and health of workers exposed to carcinogenic substances.

A lower net cost method for converting the energy stored in oil shale and other natural bituminous materials such as oil sandstone and asphalt rock to a usable form is needed. Such a method must be adaptable to handle large volumes of material, preferably in a continuous flow through a closed system, to obtain a high yield of products. The system should efficiently employ a low cost source of energy and be designed to minimize the necessity for costly ecological control measures.

It is a primary object of the present invention to efficiently process natural bituminous materials including oil shale and oil sandstone and asphalt rock along with carbonaceous materials such as coal and lignite to obtain carbonaceous oil and gas and other valuable products in high yield.

It is another object of the present invention to provide a method which enables large volumes of oil shale and similar materials such as oil sandstone and asphalt rock along with such carbonaceous materials as coal and lignite to be processed, preferably in a continuous flow through a closed system.

It is a further object of this invention to utilize low-cost sources of energy in the processing of oil shale and other similar materials such as oil sandstone and asphalt rock.

It is yet another object of this invention to employ economical energy sources while minimizing the necessity for costly ecological control measures.

It is still another object of this invention to produce multiple hydrocarbon and other products simultaneously which can serve as desirable petroleum substitutes.

Probably only because since antiquity the blast furnace has functioned as the iron and steel industries' major tool for converting iron ore to molten iron, few have considered the desirability of finding ways to adapt it for other major uses, notwithstanding its fuel efficient basic design and unique capacity to internally perform multiple manufacturing operations simultaneously in a closed ecologically acceptable system capable of consuming very large amounts of raw materials. Those who are familiar with methods converting coal to gas are, however, aware of the historical productivity of slagging ash gas producers and how they have been especially useful when low grade solid fuels were the available raw material. The slagging ash gas producer is, of course, an underdeveloped blast furnace prototype.

U.S. Pat. application Ser. No. 158,709 filed June 12, 1980 reveals how, improved by minor modifications, zone controlled blast furnaces can be operated either as highly efficient hot metal producing blast furnaces utilizing heat and reducing gas produced externally to reduce their consumption of high-priced ecologically difficult to produce coke, or in an entirely different manner to produce maximum quantities of specification gases from low-cost sources such as low grade coal or lignite and recycled top gases. In gas mode operations, no coke is charged and the iron oxide charge is very small or zero. The amount of CO in the gas converted to $CO_2$ in the reduction of iron oxides is small, improving the Btu content of the exit gases, and the heat that would have been employed to melt the iron is largely consumed in the endothermic reactions involved in reconverting recycled $CO_2$ to CO and $H_2O$ to $H_2$ and CO.

In accordance with this invention, a blast furnace can also be employed to carry out the unique assignment of extracting volatile products from the kerogen found in oil shale or the like while simultaneously manufacturing gas from coal or the like and the carbonaceous residual in oil shale which does not volatilize, and melting the other residuals to form a slag suitable for manufacturing slag products. The non-premium coal or other low-cost carbonaceous material such as lignite being gasified in addition to supplying the process heat, furnish the char from which is formed the constantly renewed carbon grate required in the bosh to facilitate the movement of gases upward and molten materials downward.

To adapt a blast furnace to remove kerogen products from oil shale, the only major modifications in design desirable are the installation of auxiliary tuyeres in the stack for use in removing Na, NaCN, K and KCN recycling within the stack and a waste heat boiler to capture a greater than conventional amount of sensible heat in the exit gas, as well as condense kerogen products, tar and other nongaseous vapors.

The practice required is very different from conventional or zone controlled practices, as is the heat profile which will be maintained in the stack. The exit gas temperature will be maintained high enough to keep the kerogen products and tar components in the gas in a vaporous form at the point of exit. The quality of the top gas remaining after the kerogen and tar fractions have condensed out is insured by combusting the char in front of the primary tuyeres with a blast enriched with up to 100% $O_2$ to limit the $N_2$ content. Desulfurization of both the gases and the hot metal produced becomes an external instead of an internal operation, and the characteristics of the slag are not tailored toward this end but rather to a unique end use.

In accordance with this invention there is provided a method of operating a blast furance to process a natural material selected from the group consisting of oil shale, oil sandstone, asphalt rock or mixtures thereof comprising:

(a) charging a first carbonaceous material selected from the group consisting of oil shale, oil sandstone, asphalt rock or mixtures thereof and a second carbonaceous material to the top of a blast furnace;

(b) burning the carbonaceous char material remaining when the burden reaches the lower portion of the blast furnace in front of the primary tuyeres to provide a hot, upwardly-moving gas stream containing CO and $H_2$ to vaporize recoverable hydrocarbons contained in the carbonaceous material as the carbonaceous material moves downwardly through the blast furnace;

(c) withdrawing a gas containing hydrocarbons CO, $H_2$ and vaporized carbonaceous oil and tar from near the top of the blast furnace; and (d) withdrawing molten slag from near the bottom of the blast furnace.

The preferred natural bituminous material for use according to the method of the invention is oil shale. While the invention is discussed with particular relation to oil shale, it is to be understood that the invention is equally applicable to other natural bituminous materials such as oil sandstone and asphalt rock.

The charge will include oil shale, oil sandstone, or asphalt rock, or a mixture thereof, and a second solid carbonaceous material. The second carbonaceous material, inter alia, will supply heat to the furnace and will form a char grate in the lower portion of the blast furnace. The choice of carbonaceous materials is within the skill of the art. Coal and lignite constitute preferred materials to employ as the second carbonaceous material.

As the charge described descends in the stack and acquires heat from the ascending gas stream, both the oil shale and the carboniferous charge such as coal or lignite start yielding their volatile components to the gas stream. By the time the burden reaches the bosh as the result of volatilization and pyrolyzation, what remains is a char, slag forming materials and reduced iron. The latter two melt and trickle down through the char grate which is continuously being consumed in front of the primary tuyeres by combustion with the conventionally heated but oxygen enriched hot blast. Molten iron produced from the reduction of the iron oxides found in oil shale gradually accumulates in the bottom of the furnace and a much larger molten layer of slag accumulates on top of it and is more frequently removed, employing conventional methods.

Gas removed from the top of the blast furnace contains volatilized oil, gaseous hydrocarbons, CO and $H_2$ obtained from the pyrolysis and volatilization of oil shale and the carbonaceous charge, the partial combustion of char carbon and the dissociation of steam. The slag produced is removed from the bottom of the furnace in the conventional manner and is suitable for processing into synthetic igneous-rock castings in the manner described in U.S. Pat. application Ser. No. 158,709. Oil shale also contains iron oxides averaging 1–5% of the total weight of the oil shale. These iron oxides are reduced by the great excess of CO and $H_2$ gas present in the upmoving gas stream. The hot metal formed is collected in the bottom of the furnace and periodically removed through the iron notch as in conventional practice.

The burden composed of oil shale, a carbonaceous material such as non-premium grades of coal or lignite and any added flux utilized to improve slag characteristics within the furnace or in the slag product, is charged as near mine run as will produce a size range with pieces with diameters no smaller than ½" and larger than 8".

Some fines and very large pieces are removed before charging to insure adequate burden permeability and that enough heat reaches the center of each piece soon enough to enable adequate volatilization and pyrolyzation to take place before pieces descend into the bosh zone. With some burdens, it may be necessary to employ a more restrictive size range.

The relative proportions of oil shale and carbonaceous charge are adjusted as needed to provide the process heat required to optimize hydrocarbon oil and gas production. Steam may be injected through the primary tuyeres to control the flame temperature.

The top gas, which is withdrawn from the top of the furnace at a temperature of not less than about 400° C., contains in a vaporous form much of the hydrocarbon content of the oil shale. This gas before passing through the conventional dust catcher will be processed by facilities preferably including a waste heat boiler or the equivalent used to reclaim unused sensible heat in the exit gas as well as condense out kerogen oil, tar and other vapors. After going through a conventional dust catcher the remaining top gas may be directed to a gas refinery for further processing, mainly cleaning, and removal of S compounds, to produce a medium Btu gas having about 300 to about 600 Btu (e.g., 300 per cubic foot) with widespread use as a utility fuel or to be more extensively processed to produce a high Btu line pipe fuel (e.g., about 600 to about 1100 Btu per cubic foot). Steam generated by the heat of the top gas may be directed to a power plant to generate electricity. When the particulate residue in the dust catcher contains a sufficient proportion of unburned carbonaceous matter, it may be consumed by directly injecting it into the blast furnace through the primary tuyeres.

The Btu value of the blast furnace top gas which remains after condensable hydrocarbon values are removed will be controlled largely by adding $O_2$ to the hot air blast proportionately reducing the $N_2$ content. A blast furnace charged with a solid carbonaceous material and oil shale and "blown" with a hot air blast enriched, to any degree economic, with $O_2$ (up to 100%) will yield a top gas having a proportionately favorable Btu content even after the high-energy volatilized liquid hydrocarbons initially contained therein have been removed. When the equivalent of utility line pipe gas is desired, 100% $O_2$ is used in the blast and a product gas with a Btu content of about 400 to about 500 is generated. This top gas can then be desulfurized outside the furnace by conventional means, shifted to approximately a 3:1 $H_2$:CO ratio, further treated to remove $CO_2$, and then catalytically converted to hydrocarbons including methane. When production of maximum efficiency boiler fuel is desired, a lowered $O_2$ content in the hot air blast is used to produce a top gas with a Btu content near or slightly lower than 300, and the only post-treatment steps required are the removal of particulate material and desulfurization. It is preferable to produce a top gas which has a Btu value of at least about 300 after removal of the volatilized liquid hydrocarbons to insure higher boiler efficiency.

The slag which is periodically removed from the blast furnace through the slag notch may be further processed to produce synthetic igneous-rock castings. Pigments may be added to the molten slag after removal from the blast furnace or may be added to the blast furnace with the charge to improve slag appearance characteristics.

The molten iron formed descends through the carbon grate to the bottom of the furnace and is periodically removed through the iron notch.

Oil shale contains significant quantities of Na and K compounds, which tend to recycle and accumulate within the furnace stack. Such accumulation results in accelerated deterioration of the refractory brick lining of the blast furnace. Other adverse effects of a buildup of alkali metals in the furnace include the formation of accretions of alkali metal compounds on the inside wall surfaces of the furnace and on surfaces of the burden, which inhibits the downward movement of the burden and the upward flow of gases. Additionally, these compounds are themselves valuable, and it is desirable to recover and productively use them. For further information on alkali metal behavior in a blast furnace, see Stephenson, "Formation of Cyanides and Alkalis in the Blast Furnace", AISI Technical Committee on Blast Furnace Practice, Pittsburgh, Dec. 4–5, 1969; Sieger and Swinburn, "Alkali Reduction in the Blast Furnace", AISI Regional Technical Meeting, Pittsburgh, Nov. 7, 1973; and Kjellman, "Some Experiences with Alkali-Rich Furnace Charges", Jernkont Ann., 1974, 158, 39–49.

As is well known in the art, providing a slag high in $SiO_2$ content expedites the removal of alkali found in a blast furnace, since alkali metals and $SiO_2$ combine to form silicates which are thus removable from the furnace in the slag. However, with high concentrations (1 to 5%) of either Na or K, as are present when oil shale is one of the major components of a blast furnace burden, removal as silicates in the slag will normally be inadequate making it necessary to develop other means of removal.

According to one aspect of the invention, a method for effectively removing alkali metals from the blast furnace has been provided. This method depends on the purging of gases containing alkali metals from the blast furnace through suitable ports or tuyeres. When operating with the kind of high temperature furnace practice required to process oil shale and get the kerogen out the top it has been found that the Na, NaCN and KCN content will be most easily purged from the blast furnace at a point just above the mantel. However, the K content is preferably purged from the furnace at a point below but near the point halfway between the mantel and the top of the stack.

The heat lost to the burden during purge cycles may be restored to the furnace by accordingly increasing the coal to oil shale ratio during these periodic intervals. The hot air blast may be reduced in volume during purge cycles in order to reduce the volume per minute of high temperature gas diverted out the sides and delivered direct to the waste heat boiler which must be cooled in the waste heat boiler to condense Na, NaCN, KCN and K vapors before the gas stream leaves and enters the dust catcher.

Na, NaCN and KCN accumulated in the blast furnace should be purged first, followed by purging of K vapor. The method may be carried out best by providing two auxiliary sets of tuyeres located above the bosh. As shown in FIG. 1, each set of auxiliary tuyeres may proceed around the entire circumference of the blast furnace, and is provided with suitable manifold means (not shown) to channel the gases removed from the blast furnace thereby to their destination. One set of tuyeres, located just above the mantel, is used to expedite the periodic removal or "purging" of Na, NaCN and KCN in a vaporous form. The second set is also above the mantel but is closer to the point halfway between the mantel and the top of the blast furnace, at a point where the burden has by volatilization and pyrolysis yielded its major kerogen derived content. This tuyere set is periodically used during purge cycles to remove gas containing K vapors. Other purging combinations carried out through tuyeres located above the mantel optionally might be used to mechanically remove recycling alkali metals provided they comprehend the fact that Na compounds are reduced and vaporized at higher temperatures and consequently lower in the stack. The purge tuyere openings are advantageously placed so as to purge soon after the vaporization temperature is reached. By purging Na, NaCN and KCN first below where K content materials are reduced, melted and vaporized, a redeposit which would be released during the K content purge, made through a tuyere set located higher in the stack, is avoided.

In normal operation, the temperature of the top gas entering a waste heat boiler will be maintained at no lower than 400° C. to expedite the removal inside by condensation of the kerogen oil and tar entering in a vaporous form. As the gas progresses through the waste heat boiler which may be placed in a slanting position, it decreases in temperature and vapors present condense out trickling down the sides of the boiler and are removed by gravity at various points through the bottom side. Those vapors with the highest vaporization temperature condense out first. The sequence when top gas is flowing through the waste heat boiler will be NaCN and KCN, Na and K, tar components and kerogen. The alkali content will be small. Most of the material being condensed out will be tar and kerogen.

When during a periodic purge cycle a reduced volume of gas is being diverted directly through auxiliary tuyere set one located above the mantel to the waste heat boiler, the materials being condensed out of the gas entering at over 1,000° C. will be NaCN, KCN and Na. To the extent the openings in the bottom of the waste heat boiler which are employed in the normal operation are valved off, other openings may be employed to remove the partially separated condensates present in liquid form during purge cycles. When the number one auxiliary tuyere set purge cycle is completed, the conduit used for removal is valved off to make it possible, when processing gas delivered from auxiliary tuyere set two, to reclaim a condensate which is largely K in liquid form. The separation will only be partial in all cases, because of residuals and droplet nuclei and because K or Na not converted to an oxide in the recycling process will vaporize more quickly than the major amount which in recycling changes to oxides which must be reduced before they almost instantly melt and vaporize.

Except in extreme cases, to conserve heat and make possible a better separation of condensates, purging will be carried out sequentially and the valves as shown in FIG. 1 will be used to alternately eliminate the flow from one set of auxiliary tuyeres while the other set is being employed. To attain maximum lining protection and expedite the continuous removal of alkali metals, KCN and NaCN, an alternate method is to allow a fraction of the gas stream to be continuously diverted simultaneously, through auxiliary tuyere sets one and two, to the waste heat boiler.

An alternate method of cleaning gas removed through auxiliary tuyeres during purge cycles may be carried out by passing the gas through a wet wash tower to remove Na, NaCN, KCN and K as well as dust particles prior to delivery of the gas to the gas refinery.

Electrostatic cleaning methods may also be employed if desired.

By employing a waste heat boiler to remove vaporous material from the gas streams leaving the blast furnace and a dust catcher to remove particulate material a use of water greater than conventional is avoided. Established improved conventional methods of reclaiming the water used for other purposes are used to make necessary the consumption of only relatively small amounts of make-up water.

By utilizing the continuous closed system blast furnace process for the cogeneration of oil from the kerogen in oil shale and gas from coal all types of pollution can be minimized using known economically sound techniques. It is possible to reclaim virtually 100% of the hydrocarbons contained in the kerogen content of the oil shale. Most of the products may be recovered as hydrocarbons which are liquid at room temperature and pressure and almost all of the balance along with the gases formed from the volatilization, pyrolysis and combustion of coal. The yield ratio of usable product to raw materials approaches 96% because valuable slag products will also be simultaneously produced. Minimal heat energy losses are of course inherent to the blast furnace method of exposing a downward moving solid burden to the up moving heat and gas generated near the bottom. Also, all gaseous products leaving the furnace are preferably passed through conventional heat recovery means such as a waste heat boiler after leaving the top of the furnace.

A typical raw material charge when 100% $O_2$ is used as the hot air blast is: 2,000 pounds of oil shale, 2,000 pounds of low-grade coal, 945 pounds of $O_2$ and 106 pounds of steam.

The products of such a charge are approximately: 30 gallons of hydrocarbon oil; 41,500 cubic feet of gas with a Btu content close to 500 Btu; 1,564 pounds of slag suitable for the manufacture of synthetic igneous-rock castings; 96 pounds of molten iron; about 15 pounds of K and 65 pounds of Na which leave the furnace as silicates in the slag, as vaporous Na or K or as vaporous NaCN or KCN.

BRIEF DESCRIPTION OF THE FIGURE

FIG. 1 schematically illustrates a preferred embodiment of the invention and the flow of materials. The explanation that follows makes reference to it.

DETAILED DESCRIPTION OF THE INVENTION

Oxygen from the oxygen generator system (1) is combined with air, fed through the power house (2) to provide an oxygen enriched blast, which is directed into the blast furnace stove (3). The blast furnace stoves (3), fueled normally by blast furnace medium Btu top gas (Utility Gas), burned by air, are used to heat an oxygen-rich hot air blast which is directed through the primary tuyeres (4) into the lower portion of the bosh to burn in front of them the char formed from the carbonaceous charge. A carbonaceous material consisting of, for example [1] low-grade coal, or lignite (or a mixture), [2] oil shale, and [3] any additional flux materials required to control the slag viscosity or improve the characteristics of synthetic igneous-rock castings made from the slag, is continuously charged into the top of the blast furnace (5). As the charge begins to descend inside the furnace it is pre-heated and moisture is driven off. As the charge descends lower in the furnace stack, volatile components in both the oil shale and the carbonaceous material are driven off and pyrolysis takes place. The gaseous substances which are evolved ascend the furnace stack. When the charge reaches the bosh, the slag forming components of the oil shale and the carbonaceous material and any added flux materials and slag modifiers including colorants, are melted and trickle down through the char grate formed from the carbon remaining after the pyrolysis of the carbonaceous charge, into the hearth. The continuously renewed carbon grate is consumed in front of the primary tuyeres (4) by the hot air blast enriched with $O_2$ (up to 100%), the $O_2$ added to reduce the relative $N_2$ content in the top gases and to increase the practical furnace operating rate, and steam is used to control the flame temperature. The gas removed from the top of the furnace is passed through the waste heat boiler (6) to condense the hydrocarbon oil and tar fractions and any amounts of NaCN, KCN, Na and K that may be present. The partially cooled gas stream then enters a dust catcher (7) of the conventional type where its velocity is decreased and its direction changed forcing it to drop the major portion of its dry dust load before going on to the refinery (8). A refinery (8) employs conventional practices to desulfurize the rich in hydrocarbon gases and to further process the condensed tar, hydrocarbon oil and other materials delivered in liquid form. Steam produced in the waste heat boiler and utility gas produced in the refinery may be utilized to produce electricity in a power plant (9). Molten slag is removed from the slag notch (10) and further processed in slag products manufacturing (12) to produce synthetic igneous-rock castings. Molten iron is periodically removed at the bottom of the furnace via the iron notch (11). Purge cycles are periodically employed to remove recycling Na, NaCN, KCN and K vapors from the furnace using, respectively, auxiliary tuyere sets (13) and (14) both located above the mantel (17). Valves (15) and (16) are employed to control the flow of gas containing Na, NaCN, KCN and K vapors out the sides of the stack during purge cycles and into the waste heat boiler (6).

The preferred embodiment of the invention as described in the specification and shown in the drawing is illustrative only. It is contemplated that possible modifications will be apparent to those skilled in the art and the invention is limited only by the scope of the appended claims.

I claim:

1. A method of operating a blast furnace to process a natural material selected from the group consisting of oil shale, oil sandstone, asphalt rock or mixtures thereof comprising:

charging a first carbonaceous material selected from the group consisting of oil shale, oil sandstone, asphalt rock or mixtures thereof and a second carbonaceous material to the top of a blast furnace;

burning the carbonaceous char material remaining when the burden reaches the lower portion of the blast furnace in front of the primary tuyeres to provide a hot, upwardly-moving gas stream containing CO and $H_2$ to vaporize recoverable hydrocarbons contained in the carbonaceous material as the carbonaceous material moves downwardly through the blast furnace;

withdrawing a gas containing hydrocarbons, CO, $H_2$ and vaporized carbonaceous oil and tar from near the top of the blast furnace; and withdrawing molten slag from near the bottom of the blast furnace.

2. The method of claim 1 wherein oil is recovered by condensation from the gas removed at the top of the blast furnace.

3. The method of claim 2 wherein heat released by condensation and the transfer of sensible heat generates steam.

4. The method of claim 1 wherein the first carbonaceous material is oil shale.

5. The method of claim 1 wherein the second carbonaceous material is coal.

6. The method of claim 5 wherein the coal is lignite.

7. The method of claim 1 wherein the first carbonaceous material is oil shale and the second carbonaceous material is coal.

8. The method of claim 1 wherein burning of char made within the blast furnace from carbonaceous material charged is accelerated by continuously injecting a hot air blast into the lower portion of the blast furnace.

9. The method of claim 8 wherein the hot air blast contains at least 50% oxygen.

10. A method of operating a blast furnace to process a natural material selected from the group consisting of oil shale, oil sandstone, asphalt rock or mixtures thereof comprising:

charging a first carbonaceous material selected from the group consisting of oil shale, oil sandstone, asphalt rock or mixtures thereof and a second carbonaceous material to the top of a blast furnace;

burning the carbonaceous char material remaining when the burden reaches the lower portion of the blast furnace in front of the primary tuyeres to provide a hot, upwardly-moving gas stream containing CO and $H_2$ to vaporize recoverable hydrocarbons contained in the carbonaceous material as the carbonaceous material moves downwardly through the blast furnace;

withdrawing a gas containing hydrocarbons, CO, $H_2$ and vaporized carbonaceous oil and tar from near the top of the blast furnace;

withdrawing a gaseous flow containing at least one alkali metal or alkali metal compound from the blast furnace through the sides at a point below the top of the stack; and withdrawing molten slag from near the bottom of the blast furnace.

11. The method of claim 10 wherein a set of auxiliary tuyeres located above the mantel of the blast furnace and much closer to the mantel than to the top of the blast furnace is employed to remove a gaseous flow rich in vaporous alkali metals from the blast furnace.

12. The method of claim 10 wherein a set of auxiliary tuyeres located above the mantel of the blast furnace and below but near the point halfway between the mantel and the top of the blast furnace is employed to remove a gaseous flow rich in vaporous alkali metals from the blast furnace.

13. The method of claim 11 wherein the principal alkali metals contained in the gaseous flow are in the form of sodium, sodium cyanide and potassium cyanide.

14. The method of claim 12 wherein the principal alkali metal contained in the gaseous flow is potassium.

15. The method of claim 10 wherein two sets of auxiliary tuyeres located above the mantel of the blast furnace including one set of tuyeres which is much closer to the mantel than to the top of the blast furnace and an additional set of auxiliary tuyeres which is located below but near the point halfway between the mantel and the top of the blast furnace are employed to remove a gaseous flow rich in vaporous alkali metal values from the blast furnace.

16. The method of claim 15 wherein the principal alkali metals contained in the gaseous flow are sodium and potassium.

17. The method of claim 13, 14 or 16 wherein the tuyeres are employed only during periodic purge cycles, to remove accumulated gases from the blast furnace.

18. The method of claim 15 wherein the two sets of auxiliary tuyeres are alternately operated so as to effect intermittent and sequential removal of a gaseous flow rich in vaporous alkali metals from the blast furnace.

19. The method of claim 1 wherein molten iron is periodically withdrawn from the bottom of the blast furnace.

20. The method of claim 8 wherein the hot air blast contains a flame temperature regulating content of steam.

21. The method of claim 2 wherein the gas withdrawn from the top of the blast furnace has a heat content of at least 300 Btu after condensation and removal of carbonaceous oil.

* * * * *